US006050230A

United States Patent [19]

Seiler et al.

[11] Patent Number: 6,050,230

[45] Date of Patent: Apr. 18, 2000

[54] LOCOMOTIVE ENGINE COOLING SYSTEM DRAIN VALVE WITH LOW VOLTAGE SENSOR

[75] Inventors: Steven J. Seiler, Greenfield, Wis.; Lorin D. Blakeslee, Erie, Pa.

[73] Assignees: Prime Manufacturing Corp., Oak Creek, Wis.; General Electric Company, Erie, Pa.

[21] Appl. No.: 09/117,189

[22] PCT Filed: Jan. 24, 1997

[86] PCT No.: PCT/US97/01125

§ 371 Date: Apr. 12, 1999

§ 102(e) Date: Apr. 12, 1999

[87] PCT Pub. No.: WO97/27386

PCT Pub. Date: Jul. 31, 1997

Related U.S. Application Data

[60] Provisional application No. 60/010,673, Jan. 26, 1996.

[51] Int. Cl.[7] ..... F01P 11/02

[52] U.S. Cl. ..... 123/41.14; 123/198 D; 137/62

[58] Field of Search ..... 123/41.14, 198 D; 137/62

[56] References Cited

U.S. PATENT DOCUMENTS

| | | | |
|---|---|---|---|
| 4,126,108 | 11/1978 | Christensen | 123/41.14 |
| 4,216,554 | 8/1980 | Glueckert et al. | 4/323 |
| 4,231,384 | 11/1980 | Christensen | 137/62 |
| 4,232,696 | 11/1980 | Burris et al. | 137/62 |
| 4,508,132 | 4/1985 | Mayfield, Jr. et al. | 137/62 |
| 4,766,925 | 8/1988 | Frantz | 137/62 |
| 5,113,892 | 5/1992 | Hull et al. | 137/62 |

*Primary Examiner*—Noah P. Kamen

*Attorney, Agent, or Firm*—Michael Best & Friedrich LLP

[57] ABSTRACT

A locomotive cooling system including a conduit adapted to conduct therethrough a flow of coolant; a power source providing a nominal voltage; and a valve assembly including a valve body defining a drain passage communicable with the conduit, a plunger movable between a closed position in which the conduit and the drain passage are separated and an open position in which the conduit and the drain passage are in fluid communication. A control assembly moves the plunger between the closed position and the open position. The control assembly, including a temperature sensor for detecting the coolant temperature, and connected to the power source. The control assembly opening the valve assembly when the system is either at a first threshold coolant temperature when the power source voltage is nominal or a second threshold coolant temperature when the power source voltage is low.

11 Claims, 3 Drawing Sheets

LOCOMOTIVE ENGINE COOLING SYSTEM DRAIN VALVE WITH LOW VOLTAGE SENSOR

This patent has priority based on Ser. No. 60/010,673 filed Jan. 26, 1996.

BACKGROUND OF THE INVENTION

1. Technical Field

The invention relates generally to drain valves for locomotive diesel engine cooling systems, and more particularly to temperature sensitive drain valves for such cooling systems.

2. Related Prior Art

Locomotive diesel engine cooling systems usually use water and corrosion inhibitors as a heat transfer medium. One of the problems that may be encountered in the operation of such a cooling system is the freezing of coolant in cold weather when the engine of the locomotive is not running. If the coolant freezes, the resulting expansion of the coolant medium can seriously damage the cooling system.

In order to prevent the coolant from freezing, a coolant drain valve is often incorporated in the cooling system. It is known to provide automatically actuating drain valves which operate to open and afford the drainage of coolant from the system when a certain temperature condition is met. For example, it is generally known for such drain valves to be operable when the coolant temperature drops to a temperature somewhat above freezing. For example, it is known for drain valves to open if the coolant temperature falls to approximately 45° F.

The drain valve in a cooling system is typically placed at a low point in the cooling system so that all of the coolant can drain out when the valve is opened. Also, the drain valve is usually located in a position so that the drain valve is exposed to ambient air surrounding the locomotive, so that the coolant temperature in the proximity of the drain valve can reliably be expected to be the coolest in the system.

It is also known to incorporate electrically operable drain valves in a locomotive engine cooling system. Such drain valves depend on the electrical system of the locomotive to provide the energy to open a solenoid or plunger to open and close the valve. For example, it is known to provide a drain valve having an electrically operated solenoid that is connected to a 74 volt DC (74 VDC) line and that draws current from the electrical system to actuate the plunger and to thereby open and close the valve. In such electrical systems, it is known to provide a battery which provides a nominal 74 VDC output.

SUMMARY OF THE INVENTION

One of the problems addressed by the invention is the concern that the electrical system of the locomotive may fail under freezing conditions. Specifically, if the voltage or potential provided by the locomotive's electrical system to the drain valve, namely the battery, fails when the engine is not running and the temperature falls to a threshold low temperature, then the electrically operated solenoid will not actuate, and the coolant system will not be drained of coolant before freezing.

The invention addresses this concern by providing a coolant system including a conduit for conducting a flow of coolant, an electrical system including a power source having a nominal voltage, and a drain valve assembly including a controller that monitors the voltage of the locomotive electric system and including a drain valve operated by the controller at different coolant temperatures depending on the status of the locomotive's electrical system.

In general, the invention provides a locomotive cooling system including a conduit adapted to conduct a flow of coolant and a power source providing a nominal voltage. The system also includes a valve assembly having a valve body which defines a drain passage communicable with the conduit. The valve body also includes a plunger that is movable between a closed position wherein the conduit and the drain passage are separated and an open position wherein the conduit and the drain passage are in fluid communication. The valve assembly also includes a control for moving the plunger between the closed position and the open position depending on the coolant temperature and the voltage of the power source. The control includes a temperature sensor for detecting the coolant temperature and is connected to the power source. The control operates to move the plunger from the closed position toward the open position at a first threshold coolant temperature when the power source voltage is nominal. The control also is operable to move the plunger from the closed position toward the open position at a second threshold coolant temperature when the power source voltage deviates from nominal.

More particularly, the invention provides a drain valve that opens and releases coolant from the cooling system at a higher than ordinary coolant temperature if the power supply voltage level falls below a threshold voltage. In one embodiment, the drain valve will operate to release water at 50° F., which is a higher than normal dump temperature, if the supply voltage drops substantially below the nominal 74 VDC potential. Specifically, the drain valve will open and dump water at 50° F. in the event the supply voltage drops below 24 VDC. Otherwise, if the power supply voltage remains above the threshold low voltage level, the drain valve will not open unless the coolant temperature falls to approximately 40° F.

In order to ensure that the drain valve remains open once it is opened, the drain valve also includes an electrical latch relay system which operates to hold the valve open. This feature protects against a premature closing of the drain valve in the event that warmer coolant flowing through the drain valve from better protected areas of the cooling system, such as the engine block, cannot "trick" the valve into closing, thus trapping water within the cooling system until the coolant temperature at the valve again drops to the opening temperature. Otherwise, if the valve closes again, freezing could occur in other remote areas before the valve can reopen.

Another possible problem may occur when a drained cooling system is refilled with cold coolant. If the coolant temperature is below the opening temperature of the drain valve, the valve may open before the system can be filled and the engine started to bring the coolant temperature up high enough so that the valve remains closed. To counteract this potential problem, the invention provides a drain valve assembly including a timed electrical lock-out feature as part of the valve's control system. Power to the valve may be locked out for a predetermined time period allowing the system to be refilled, the engine started and the coolant temperature to be raised above the valve opening temperature. In some applications, the valve power supply may be designed so that the valve is never powered when the engine is running.

Other features and advantages of the invention will become apparent to those skilled in the art upon review of the following detailed description, claims and drawings.

Figure 1:
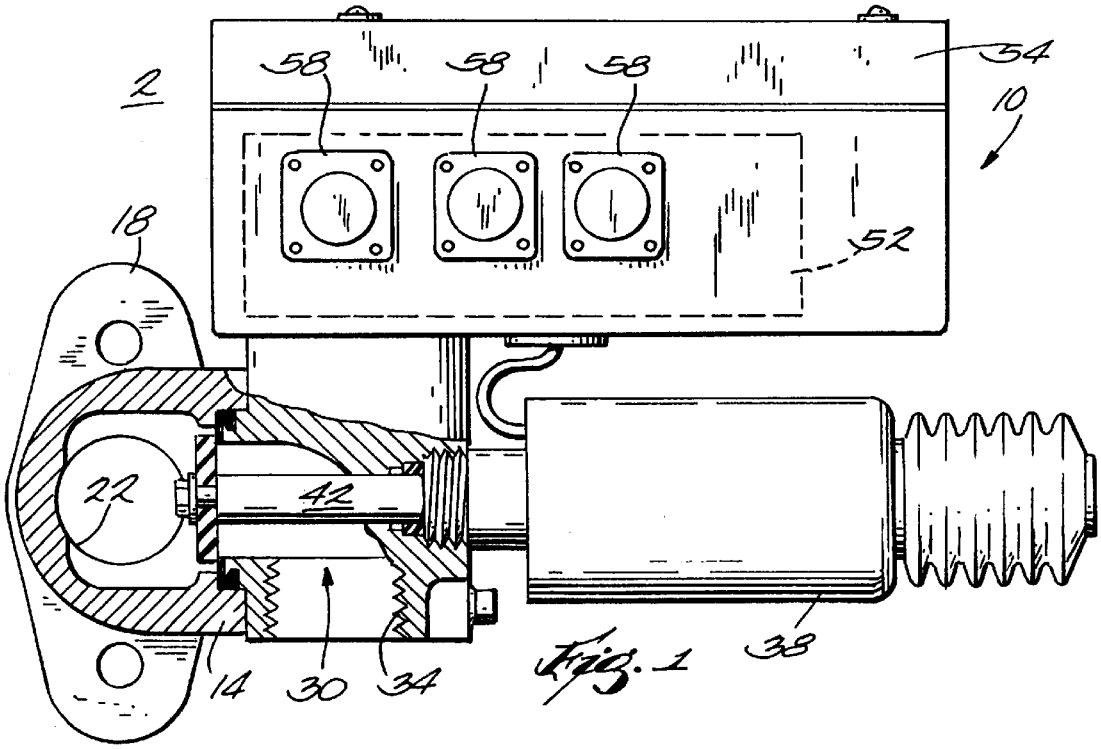
FIG. 1 is an elevational view, partially broken away for the purpose of illustration, of a drain valve assembly embodying the invention.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DETAILED DESCRIPTION OF THE PREFERRED EMBODIMENT

The drawings illustrate a locomotive engine cooling system including a conduit adapted to conduct a flow of coolant, an electrical system including a power source providing a nominal voltage, a cooling drain valve in communication with the conduit, and a control connected to the power source for operating the valve at a first threshold temperature when the electrical system voltage is nominal and operating the valve at a second threshold temperature when the electrical system voltage deviates from nominal.

Figure 2:
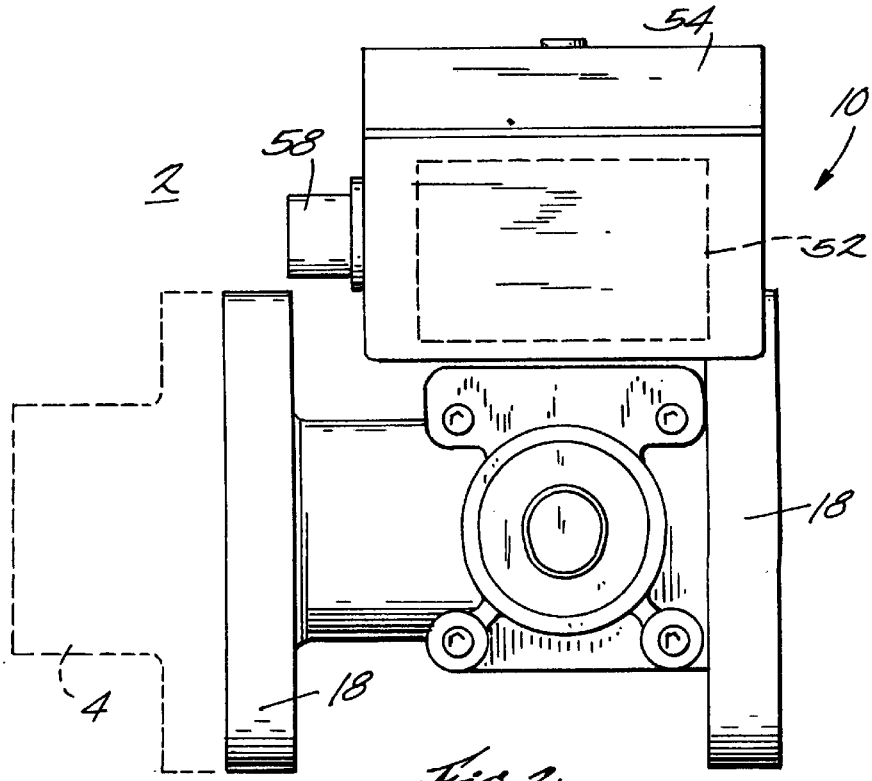
FIG. 2 is an end view of the assembly shown in FIG. 1.
Figure 4:
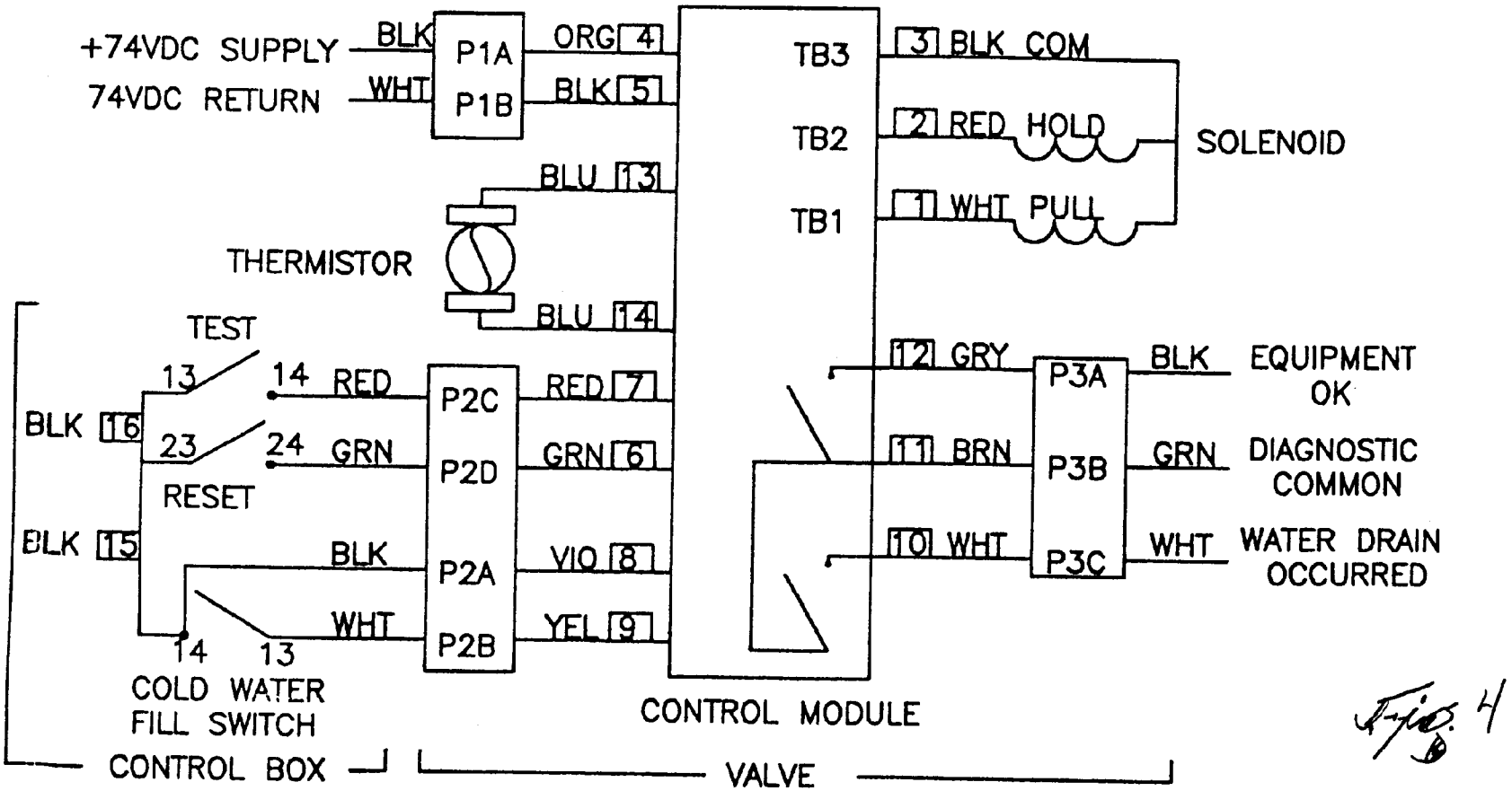
FIG. 4 is a schematic diagram illustrating the controller incorporated by the drain valve assembly shown in FIG. 1.

In particular, FIGS. 1 and 2 illustrate a locomotive cooling system 2 embodying the invention and including a conduit 4 (shown in phantom in FIG. 2) adapted to conduct a flow of coolant therethrough. The system 2 also includes an electrical system which is described in more detail below and which is shown schematically in FIG. 4.

The system 2 also includes a drain valve assembly 10. The assembly 10 includes a valve body 14 having a pair of flanges 18 connected to the conduit 4 in a conventional manner so as to conduct the flow of coolant into the valve body through a flow passage 22 extending between the flanges 18. Intermediate the flanges 18, the valve body 14 defines a valve seat 26 in the flow passage 22. The valve body 14 also includes a drain passage 30 that is communicable with the flow passage 22 by means of the valve seat 26. In the illustrated embodiment, the drain passage 30 includes a interiorly threaded portion 34 to which a drain pipe (not shown) can be fitted and through which coolant can pass when the drain passage 30 is opened.

The valve assembly 10 also includes an actuator assembly 38 that is mounted on and extends into the valve body 14. The actuator assembly 38 includes a plunger 42 having an end supporting a circular head 46 that is sized to sealingly engage the valve seat 26 so as to prevent the flow of coolant from the flow passage 22 into the drain passage 30. The plunger 42 also has a second end (not shown) that extends outwardly of the actuator assembly 38. The plunger 42 is supported by the actuator assembly 38 for movement between a first position (shown in FIG. 1) wherein the head 46 seals the valve seat 26 and a second position (not shown) wherein the head 46 is spaced from the valve seat 26 and coolant flow from the flow passage 22 into the drain passage 30 is permitted.

The plunger 42 is operably connected to a solenoid armature (not shown) within the actuator assembly. The solenoid armature is connected to the electrical system of the locomotive in a manner discussed below and can be selectively energized and de-energized to move the plunger head 46 away from and toward the valve seat 26.

The drain valve assembly 10 also includes control means 50 for monitoring various engine conditions and for selectively operating the solenoid in response to the engine conditions. More particularly, the control means 50 includes a controller 52 (shown schematically in FIG. 4) that is housed within a housing 54 which is, in turn, fixed to the drain valve body 14. The housing 54 is a water-tight, corrosion resistant enclosure for the controller 52 and is fixed to the valve body 14 by any suitable means. The housing 54 has extending therethrough three ports 58 which provide means for connecting the controller 52 to the electrical system of the locomotive, the control panel and the locomotive diagnostic system.

The relevant connections between the drain valve assembly 10 and the electrical system includes a power supply line (shown in FIG. 4) and a return line connecting the controller 52 and a battery source. The power supply provides, for example, a nominal 74 VDC output. However, if the battery is not at full strength then the voltage potential provided by the power supply decreases. This is particularly the case under cold weather conditions and when the engine of the locomotive is not running. Because the battery provides the power for energizing the solenoid, if the battery voltage is insufficient to generate enough current to actuate the solenoid, the drain valve will not operate if the battery voltage decays below a threshold voltage level. Accordingly, the voltage of the power supply line is a condition that is monitored by the controller 52 and is a factor in the operation of the drain valve.

The control means 50 also includes a temperature sensor, such as a thermistor (not shown), which is mounted on the valve body 14 so as to be in heat transfer relation to the coolant located adjacent to the valve body 14 and the housing 54. The thermistor is of a conventional construction and provides a control signal to the controller 52 indicating the coolant temperature. The controller 52 includes a test switch (shown in FIG. 4) that is operable to force the drain valve open in order to verify that the solenoid functions properly. The controller 52, as mentioned above, includes diagnostic circuitry that is operable to ascertain the proper functioning of various components of the controller 52. The controller 52 can also be connected to various signal of indicia lamps located remotely from the drain valve, e.g. in the cab of the locomotive, to indicate the status of the drain valve, e.g., open, closed, test mode, water fill mode, etc. These various drain valve operational states are further explained in the description of the operation of the controller 52.

Figure 3:
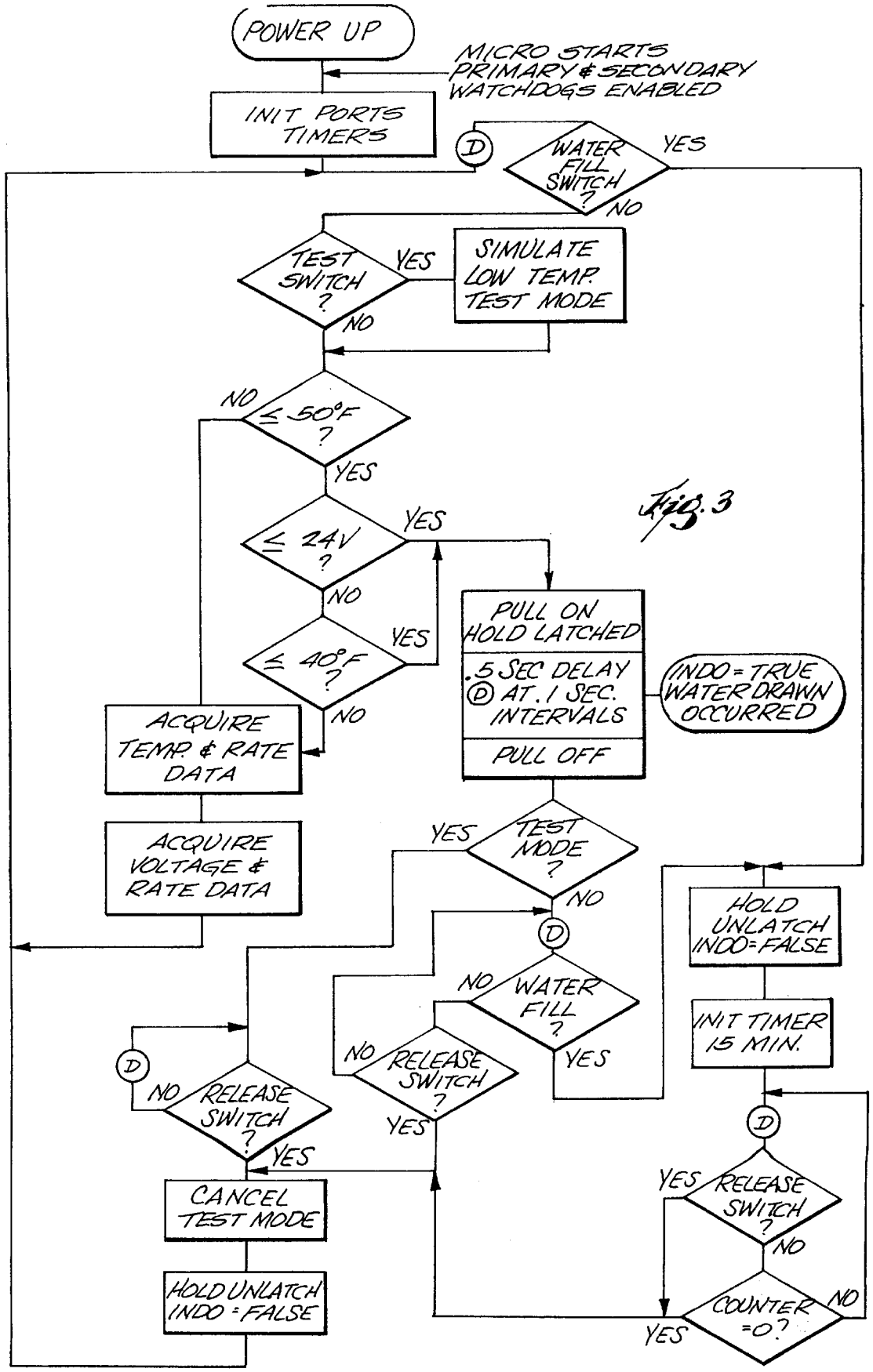
FIG. 3 is a schematic diagram illustrating the logic sequence incorporated by the drain valve assembly shown in FIG. 1.

FIG. 3 schematically illustrates the operational steps taken by the controller 52 to actuate the solenoid. The controller 52 is constructed of standard electronic components and operates according to the following logic progression, and operates the solenoid using the following steps.

After the electrical system is powered, the controller 52 is in an initialized state, and will first check the status of a drain valve test switch. If the test switch is thrown to verify drain valve operation, the solenoid is energized and the plunger 42 is moved to an open position. When the reset switch is thrown, the plunger 42 retracts and the plunger head 46 reseats on the on the valve seat 26 to seal the drain passage 30.

The controller 52 can also be disabled for a set interval during which the cooling system can be refilled. This capability is desirable in order to permit the filling of the cooling system with coolant that is colder than 40° F. The interval for filling, the starting of the engine to warm the coolant to above 40° F. can be, for example, as short as 15 minutes. After such a period of time, the controller 52 is again enabled.

If neither the test switch nor the "water fill" switch is not thrown, the controller 52 will sample the signal provided by the thermistor to determine the coolant temperature. If the thermistor signal indicates that the coolant temperature is in a first range of temperature values, i.e., above 50° F., then the controller 52 resets its time and temperature data and re-initiates the logic process. If the thermistor signal indicates that the coolant temperature is outside the first range of temperature values, i.e., is equal to or less that 50° F., then the controller 52 will next sample the power supply voltage potential. If the voltage of the power supply is outside a first range of voltage values, i.e., if the power supply voltage has dropped to equal to or less than 24 VDC, then the solenoid is energized, the plunger head 46 is pushed away from the valve seat 26 to open the drain, and to afford the flow of coolant out of the cooling system by way of the drain passage 30. The controller 52 also, in this condition, will indicate that a "water drain occurred" to the diagnostic output.

In order to prevent the premature closing of the plunger 42, which may be caused by relatively warm coolant passing through the drain valve body 14 during the draining of the cooling system, the controller 52 will maintain the solenoid in an energized state by actuating a "hold open" relay which can be reset only by an operator. Once the "hold open" relay is reset, the controller 52 returns to its initialized state.

If the thermistor signal indicates a coolant temperature less than 50° F. but the power supply voltage remains greater than 24 VDC, then the controller 52 will next determine if the coolant temperature is with a second range of temperature values, i.e., determine if the coolant temperature has fallen to less than 40° F. If so, then the solenoid is energized and the "hold open" relay is opened in the manner discussed above. If, on the other hand, the coolant temperature remains above 40° F., i.e., is outside the second range of the coolant temperatures and the power supply remains above 24 VDC, then the controller 52 resets the time, temperature and voltage parameters and re-initiates the logical progression set forth above.

The drain valve assembly 10 thus provides an electrically operable drain valve and control means 50 for operating the drain valve depending upon two variable engine conditions or input signals. The controller means 50 actuates the drain valve when the first input signal is within a first predetermined range of values, e.g., coolant temperature <40° F., for a given predetermined range of values for the second input signal, e.g., power supply potential >24 VDC, and actuates the drain valve when the first input signal is within a second predetermined range of values, e.g., coolant temperature <50° F., when the second input signal is outside the respective first range of values, e.g., power supply potential <24 VDC.

Other features and advantages of the invention are set forth in the following claims.

We claim:

1. A locomotive cooling system comprising:

a conduit adapted to conduct therethrough a flow of coolant;

a power source providing a nominal voltage; and a valve assembly including a valve body defining a drain passage communicable with the conduit, a plunger movable between a closed position wherein the conduit and the drain passage are separated and an open position wherein the conduit and the drain passage are in fluid communication, a control for moving the plunger between the closed position and the open position, the control including a temperature sensor for detecting the coolant temperature and the control being connected to the power source, the control being operable to move the plunger from the closed position toward the open position at a first threshold coolant temperature when the power source voltage is nominal and being operable to move the plunger from the closed position toward the open position at a second threshold coolant temperature when the power source voltage deviates from nominal.

2. A locomotive cooling system as set forth in claim 1 wherein the temperature sensor is a thermistor located in thermal contact with the coolant.

3. A locomotive cooling system as set forth in claim 1 wherein the first threshold temperature is lower than the second threshold temperature.

4. A locomotive cooling system as set forth in claim 3 wherein the control operates to move the plunger at the second threshold temperature when the voltage of the power source is a voltage below the nominal voltage.

5. A locomotive cooling system as set forth in claim 1 wherein valve assembly includes a housing mounted on the valve body and wherein the control is located within the housing.

6. A drain valve assembly for a locomotive cooling system, said valve assembly comprising:

a valve body defining a drain passage and adapted to be communicable with a conduit conducting a flow of coolant;

an actuator assembly mounted on the valve body and including a plunger movable between a closed position wherein the plunger prevents the flow of coolant from the conduit into the drain passage and an open position wherein the plunger affords a flow of coolant into the drain passage from the conduit;

a control for selectively actuating the actuator assembly, the control being connected to a power supply providing a nominal voltage and monitoring the voltage of the power supply, and the control including a temperature sensor located in heat transfer relation to the flow of coolant and providing a control signal indicating the coolant temperature, the control moving the plunger from the closed position toward the open position depending upon the monitored voltage and the indicated coolant temperature.

7. A drain valve assembly as set forth in claim 6 wherein the control actuates the drain valve when the temperature signal is within a first predetermined range of values for a given predetermined range of voltages provided by the power source, and actuates the drain valve when the temperature signal is within a second predetermined range of values when the power source voltage is outside the respective first range of values.

8. A valve assembly adapted for use in a locomotive engine cooling system, the locomotive cooling system including a supply of coolant having a temperature and including a power source providing a voltage, the valve assembly comprising:

a valve body defining a flow passage and a drain passage communicable with the flow passage;

a plunger movable between a closed position wherein the flow passage and the drain passage are separated and an open position wherein the flow passage and the drain passage are in fluid communication; and a control for moving the plunger between the closed position and the open position at two different coolant temperatures depending upon the power source voltage.

9. A valve assembly as set forth in claim 8 wherein the power source provides a nominal voltage, wherein the control includes a temperature sensor for detecting the coolant temperature and the control being connected to the power source, and wherein the control is operable to move the plunger from the closed position toward the open position at a first threshold coolant temperature when the power source voltage is nominal and being operable to move the plunger from the closed position toward the open position at a second threshold coolant temperature when the power source voltage deviates from nominal.

10. A valve assembly as set forth in claim 9 wherein the control is selectively operable to prevent movement of the plunger during refilling of the cooling system.

11. A method for operating a drain valve for a locomotive cooling system having a supply of coolant, said method comprising:

providing a control signal indicating the temperature of the coolant;

providing a power supply for actuating the drain valve and providing a nominal voltage;

providing a controller for monitoring the control signal and the power supply voltage;

initializing the controller;

determining if the control signal is within a first range of temperature values;

returning to the initializing step if the control signal is within the first range of temperature values;

determining if the power supply voltage is within a first range of voltage values;

actuating the drain valve if the control signal is outside the first range of temperature values and if the power supply voltage is outside the first range of voltage values;

if the control signal is outside the first range of temperature values and if the power supply is within the first range of voltage values, determining if the control signal is within a second range of temperature values;

if the control signal is within the second range of temperature values, actuating the valve;

if the control signal is outside the second range of temperature values, returning to the initialing step.

* * * * *